US010222719B2

(12) United States Patent
Borenstain et al.

(10) Patent No.: US 10,222,719 B2
(45) Date of Patent: Mar. 5, 2019

(54) ELECTRO-PHOTOGRAPHIC PRINTING

(71) Applicant: HP INDIGO B.V., Amstelveen (NL)

(72) Inventors: Shmuel Borenstain, Ness Ziona (IL); Michael Kokotov, Ness Ziona (IL)

(73) Assignee: HP INDIGO B.V., Amstelveen (NL)

( * ) Notice: Subject to any disclaimer, the term of this patent is extended or adjusted under 35 U.S.C. 154(b) by 0 days.

(21) Appl. No.: 15/748,820

(22) PCT Filed: Oct. 29, 2015

(86) PCT No.: PCT/EP2015/075186

§ 371 (c)(1),
(2) Date: Jan. 30, 2018

(87) PCT Pub. No.: WO2017/071769

PCT Pub. Date: May 4, 2017

(65) Prior Publication Data

US 2018/0224767 A1 Aug. 9, 2018

(51) Int. Cl.
*G03G 15/02* (2006.01)

(52) U.S. Cl.
CPC ..... *G03G 15/0266* (2013.01); *G03G 15/0275* (2013.01)

(58) Field of Classification Search
CPC ..... G03G 15/0266; G03G 15/0275
See application file for complete search history.

(56) References Cited

U.S. PATENT DOCUMENTS

| | | | | |
|---|---|---|---|---|
| 5,300,990 | A | 4/1994 | Thompson | |
| 5,481,342 | A | 1/1996 | Arcaro et al. | |
| 6,253,050 | B1 | 6/2001 | Kim | |
| 6,633,735 | B2 | 10/2003 | Kellie et al. | |
| 7,756,430 | B1 | 7/2010 | Chang et al. | |
| 8,103,194 | B2 | 1/2012 | Patton et al. | |
| 2004/0081474 | A1 * | 4/2004 | Fukuyama | G03G 15/0275 399/49 |

OTHER PUBLICATIONS

Davis, N. et al., "What Causes Specks on the Paper From a Printer?", AZCentral, Feb. 28, 2013, 4 pgs, http://yourbusiness.azcentral.com/causes-specks-paper-printer-16176.html.

* cited by examiner

*Primary Examiner* — Sophia S Chen
(74) *Attorney, Agent, or Firm* — HP Inc. Patent Department

(57) ABSTRACT

A method of electro-photographic printing includes applying a background voltage to a photo imaging plate using a charge roller that moves relative to the photo imaging plate, and varying the applied background voltage as the roller moves relative to the photo imaging plate, wherein the background voltage is varied in a region of the photo imaging plate where no ink is to be transferred.

11 Claims, 6 Drawing Sheets

V_ac 700-1000V, 9-15KHz
V_dc = 1000V nominal
C_CR-PIP 1500 pF
C_CR= ~ 10 nF
R_CR 1.3 ± 30% kOhm
C_wiring ~30pF
R1_wiring > 10^9 Ohm
R2 carbon brush and wires < 100 Ohm
Zener diode breaking voltage ~500 V
C_PIP ~ 2 nF
R_PIP = 410 kOhm

ELECTRO-PHOTOGRAPHIC PRINTING

BACKGROUND

Electro-photographic printers comprise a photo imaging plate and a charge roller. A background voltage is applied to the photo imaging plate by passing the charge roller across its surface. A light source, such as a laser is shone on selected areas of the photo imaging plate to substantially discharge the selected areas and create a latent electrostatic image on a charged background. When an electrostatic ink is applied to the photo imaging plate, the potential differences between the background, the image areas and the electrostatic ink are such that the electrostatic ink is drawn to the image areas of the photo imaging plate. Thus an impression of the image areas can be printed by transferring the electrostatic ink from the photo imaging plate to a print media.

This method of printing is prevalent, for example, in industrial printers capable of printing several large sheets of paper, such as B2 sized paper, per second.

BRIEF DESCRIPTION OF DRAWINGS

Examples will now be described, by way of non-limiting example, with reference to the accompanying drawings in which.

DETAILED DESCRIPTION

Figure 1:
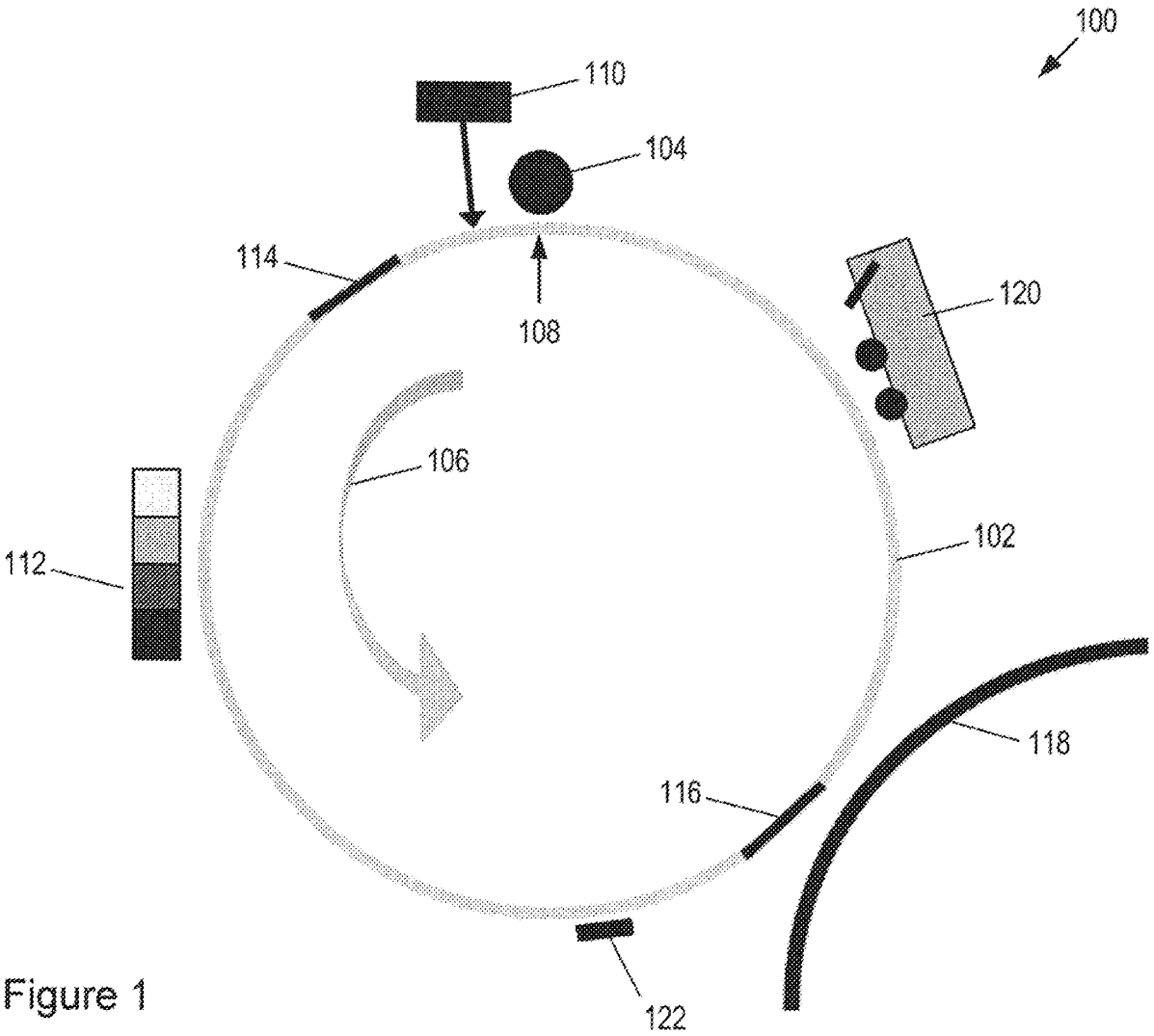
FIG. 1 shows an example electro-photographic printing apparatus.
Figure 2:
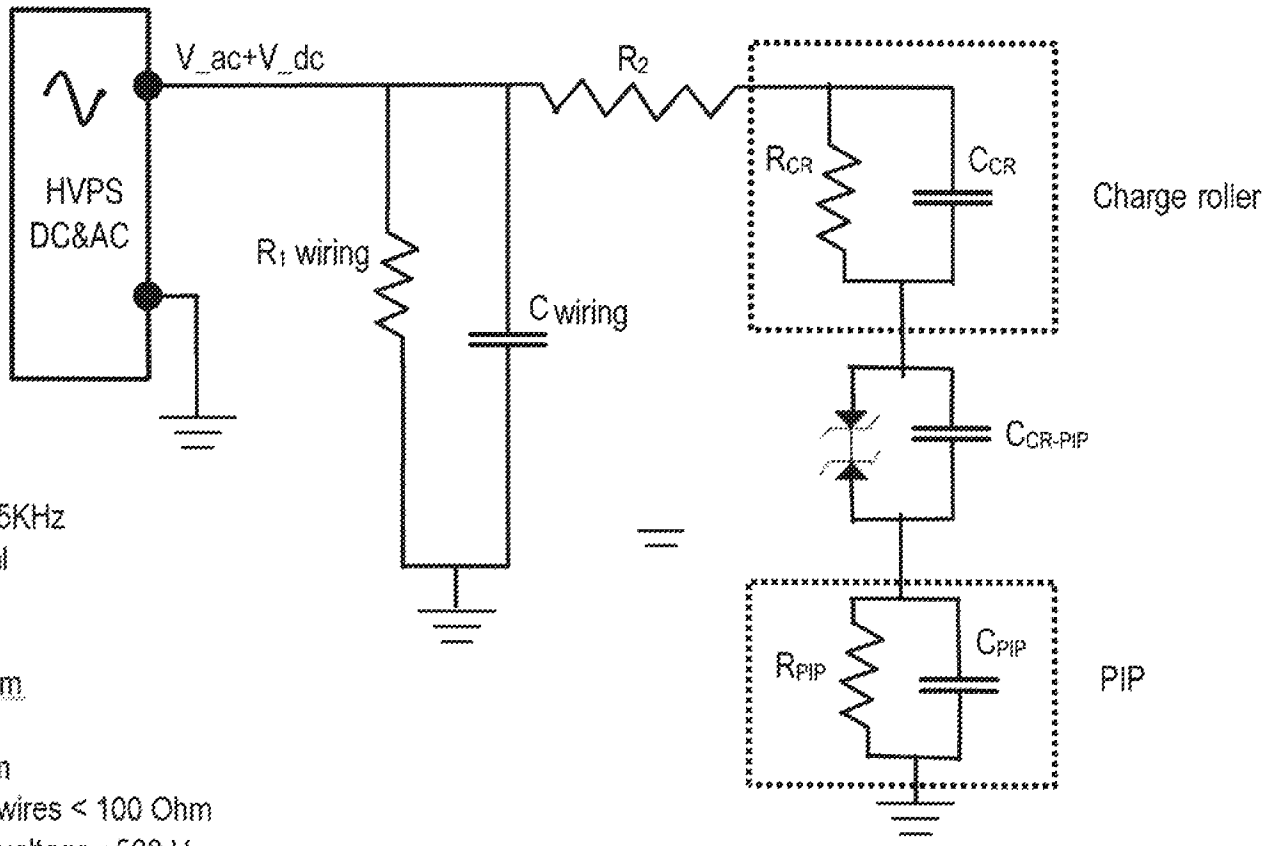
FIG. 2 shows an example of a schematic of a charge roller circuit.
Figure 3:
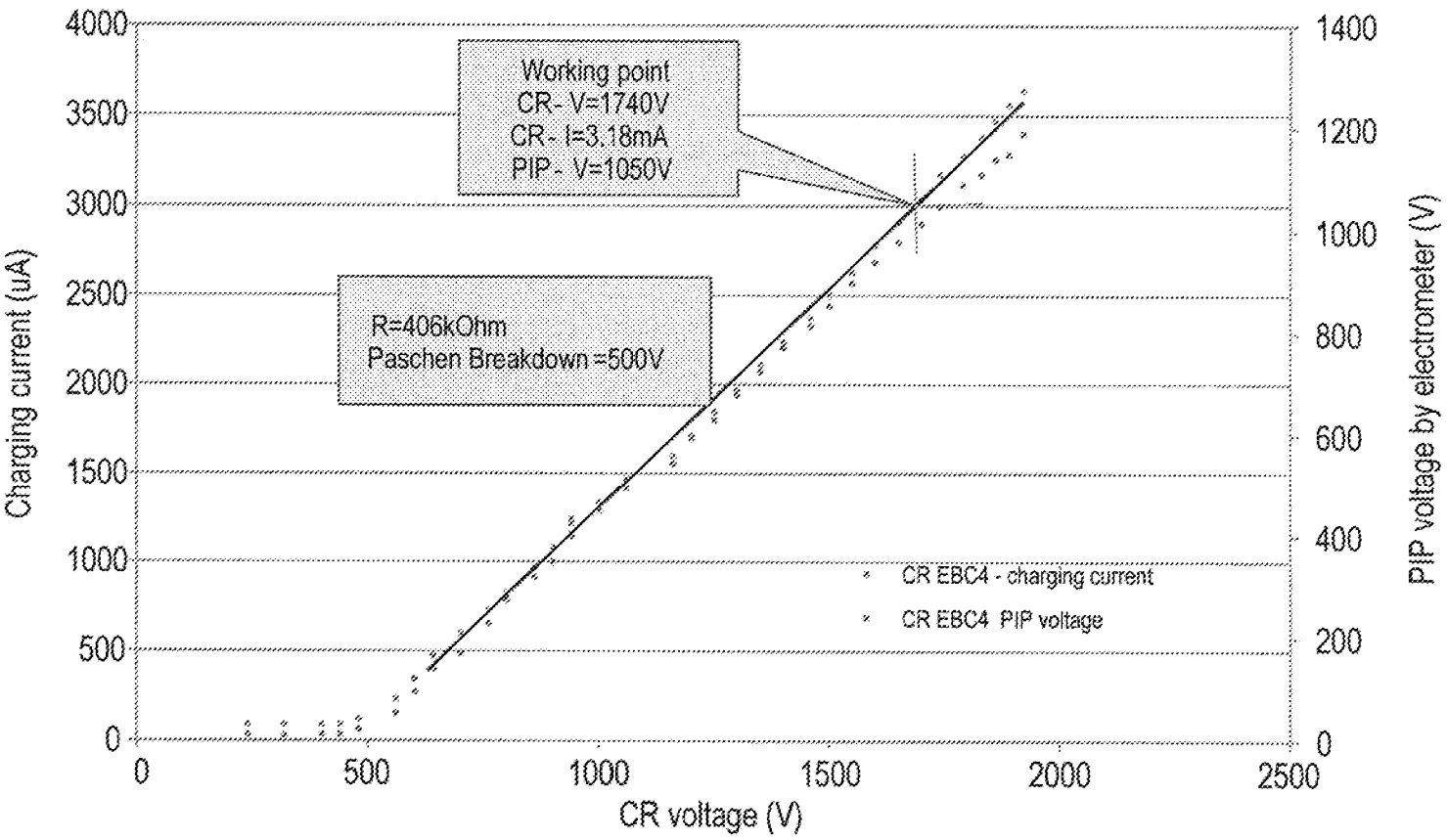
FIG. 3 shows an example of a I-V curve for charging the photo imaging plate using the charge roller.

FIG. 1 shows an example electro-photographic printing apparatus 100 comprising a photo imaging plate (PIP) 102 and a photo charging unit in the form of a charge roller 104. In this example the photo imaging plate 102 is cylindrical and rotates in the direction of arrow 106. As the photo imaging plate 102 is rotated, the charge roller (CR) 104 deposits a static charge on the photo imaging plate 102 at the point of nearest contact between the charge roller 104 and the photo imaging plate 102. This point is shown in FIG. 1 at 108 on the surface of photo imaging plate 102. The static charge deposited by the charge roller is uniform along the length of charge roller 104 and may be provided by supplying a voltage to the photo imaging plate 102 at the point 108. The voltage applied by the charge roller 104 may be referred to herein as the background voltage. In some applications, the background voltage is a negative voltage, for example, −1000V, although other voltages can be used. For reference, a schematic of an example of a charge roller circuit for use during printing is shown in FIG. 2, and an I-V curve plotting the charging current against charging voltage for charging the photo imaging plate 102 using the charge roller is shown in FIG. 3.

An image, including any combination of graphics, text and images, may be communicated to the printing apparatus 100. An imaging unit 110 shines light, such as a laser, onto selected portions of the photo imaging plate 102, the selected areas corresponding to an image that is to be printed. The light from the imaging unit 110 dissipates the static charge in the selected portions of the image area (approximately to ground) on the photo imaging plate 102 to leave a latent electrostatic image on a charged background. The latent electrostatic image is thus an electrostatic charge pattern representing the image to be printed. An electrostatic ink is then transferred to the photo imaging plate 102 by a developer roller 112. The examples described herein apply equally to electrostatic inks comprising either liquid or powder toners. In this example the electrostatic ink is approximately midway between the voltage of the background and ground and this results in an electric 'transfer vector' that forces the electrostatic ink to the image areas (i.e. grounded areas) of the photo imaging plate 102. The image can then be transferred to another roller, such as an intermediate transfer media (ITM), such as an ITM drum 118, for heating and transfer to the print media.

Conversely, ink that meets background areas at the background voltage does not transfer to the photo imaging plate 102. The potential difference between the background voltage and the developer roller 112 (i.e. voltage of the electrostatic ink) prevents ink transfer to the background. This repulsive electric vector is often referred to as the 'cleaning vector'.

The electro-photographic printer may also comprise other components such as a cleaning station (CS) 120 and a Pre Transfer Erase (PTE) station 122.

It has been appreciated that, as will be described in the present disclosure, the process described above may be improved if the charge roller varies the background voltage or cleaning vector applied to the photo imaging plate 102 as the charge roller moves relative to the photo imaging plate 102. For example, certain areas of the background may be charged to a first background voltage, whilst other areas are charged to a second background voltage. The light from the imaging unit then dissipates the static charge on selected areas of this variable background voltage.

In general, the background voltage can be set to prevent transfer of electrostatic ink to the background (i.e. areas where charge is not dissipated by the imaging unit 110). However, there is a trade-off between eliminating ink transfer in background regions and the resolution of the printer, because if the background voltage is less than (i.e. more negative than) around −1000V throughout the charging cycle, images made up of small dots can no longer be printed as the regions surrounding the small dots are so strongly repellent that they prevent electrostatic ink transfer to the dissipated dots. Therefore, in practice, the magnitude of the background voltage is restricted by the resolution of the printer. As such, in normal operation, small amounts of ink are transferred to background areas, however for most purposes this ink transfer is negligible and not visible on the final printed media.

In certain regions, however, even this small amount of ink is problematic. For example, in background areas where ink is not subsequently transferred from the photo imaging plate 102 to the substrate, a small amount of ink is accumulated on the photo imaging plate 102 in each print cycle. Over the course of many thousands of impressions, an ink layer begins to form which can become thick and crumble and spread around the photo imaging plate 102 as small dry ink particles which cause scratches and other print defects.

Figure 4:
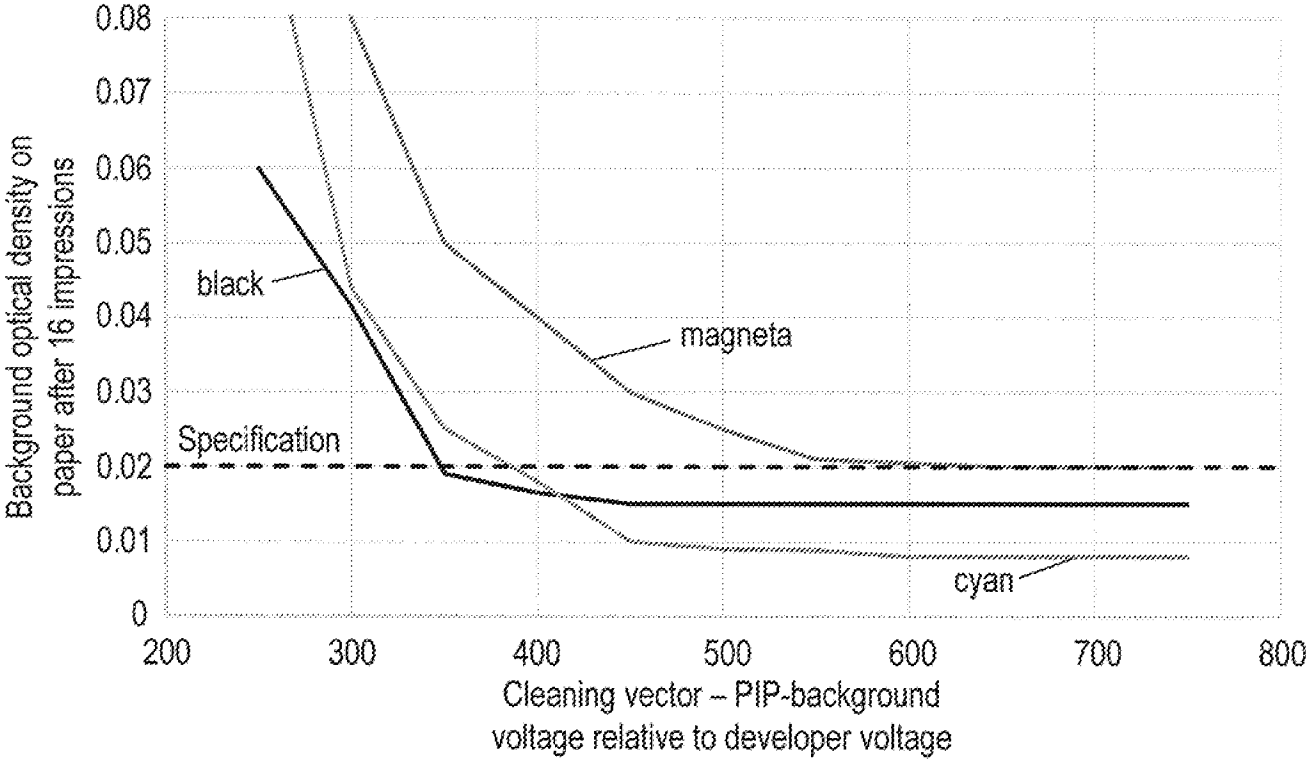
FIG. 4 shows a graph of ink deposition rates across a seam in a photo imaging plate for different cleaning vectors and ink colours.

One area where an ink layer can form in this way is at a seam 114 in the photo imaging plate 102. Cylindrical photo imaging plates such as that shown in FIG. 1 often comprise a photo imaging material wrapped around a drum. Thus a seam 114 is created where the photo imaging material partially overlaps at the join in the material. This area of the plate is not used for printing and so, despite being charged to the background voltage, small amounts of ink are deposited on the seam 114 in each cycle, leading to the formation of an ink layer as described above. This is shown in FIG. 4 which shows ink deposition rates across a seam for different cleaning vectors and ink colours. Another feature that adds to ink deposition at the seam 114, is the fact that part of the seam may not be covered with photo imaging material (such as an organic photo conductor, OPC) and may comprise a Mylar under layer to the OPC. As such, part of the seam may be made of Mylar and consequently because of "tribo" charging (friction with cleaning station sponges), the Mylar can become charged. For example, a cleaning station may comprise two sponge rollers that while rotating scrub the photo imaging plate and Mylar region by physical friction. Tribo charging is the electrostatic charging by mechanical friction of the Mylar. Tribo charging is not repeatable, and may be positive or negative. The level of charging depends on various surface conditions between the photo imaging plate and sponges, such as the age of the sponges, amount of oil in the sponges, ink residues in the oil, and the conductivity of the imaging oil.

The voltage in the seam can become positive rather than negative after being charged by the charge roller (i.e. the seam can become charged positive, rather than having the negative charge, e.g. −1000 v, of the charge roller).

The examples described herein can help to mitigate the above mentioned issues by applying a different background voltage to selected areas of the photo imaging plate 102, such as a region of the photo imaging plate where no ink is to be transferred, such as regions encompassing a seam 114. For example, if the background voltage applied to the photo imaging plate is −1000V, the voltage of the seam region can be reduced, for example to −1500V, causing the electrostatic ink to be more strongly repelled in the seam region to prevent an ink build up.

Figure 5:
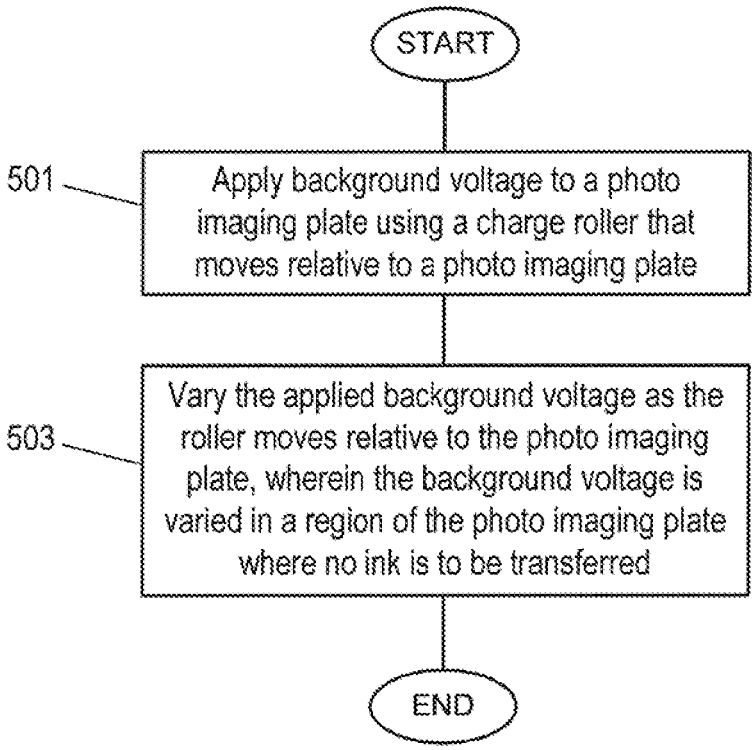
FIG. 5 shows a method according to an example.

Referring to FIG. 5, according to one example a method of electro-photographic printing comprises applying a background voltage to a photo imaging plate using a charge roller that moves relative to the photo imaging plate, stage 501, and varying the applied background voltage as the roller moves relative to the photo imaging plate, stage 503, wherein the background voltage is varied in a region of the photo imaging plate where no ink is to be transferred.

Thus, in a general example, the background voltage applied by the charge roller 104 is changed or varied in a region of the photo imaging plate 102 where residual ink transfer might otherwise accumulate, leading to the build-up of an ink layer on the photo imaging plate 102. In some examples, the background voltage may be varied in a region of the photo imaging plate where the charge roller 104 passes across regions of the photo imaging plate 102 where ink is not subsequently transferred from the photo imaging plate 102 to the print media. In some examples, the background voltage may be varied or changed across a seam 114 of the photo imaging plate 102.

In other examples, the background voltage may be varied or changed across an anti-seam 116 of the photo imaging plate 102. An anti-seam 116 may be the antipode to the seam 114 on the drum, or any other strip across the surface of the photo imaging plate 102 that lies between two image frames. For example, if the photo imaging plate 102 prints three image frames per revolution, the circumference of the photo imaging plate 102 will effectively be split into three print zones separated by three seams (a seam 114 and two anti-seams 116). It is noted that while some examples may comprise a seam having a portion, such as an under layer, that comprises a non photo imaging material (e.g. Mylar), examples may comprise an anti-seam that is all photo imaging material, such as an organic photo conductor.

In some examples, the change in voltage is a reduction of the voltage across a seam or anti-seam, for example, the voltage may be reduced from −1000V to −1500V across the seam and then increased back to −1000V for the normal background regions. The voltage applied by the charge roller 104 to seam regions may therefore be more negative than the background voltage applied to print regions. It is noted that other examples may involve varying the background voltage in other ways, for example depending upon the type of background voltage used for the normal background regions, or a particular type of printing being used in an application.

Figure 6:
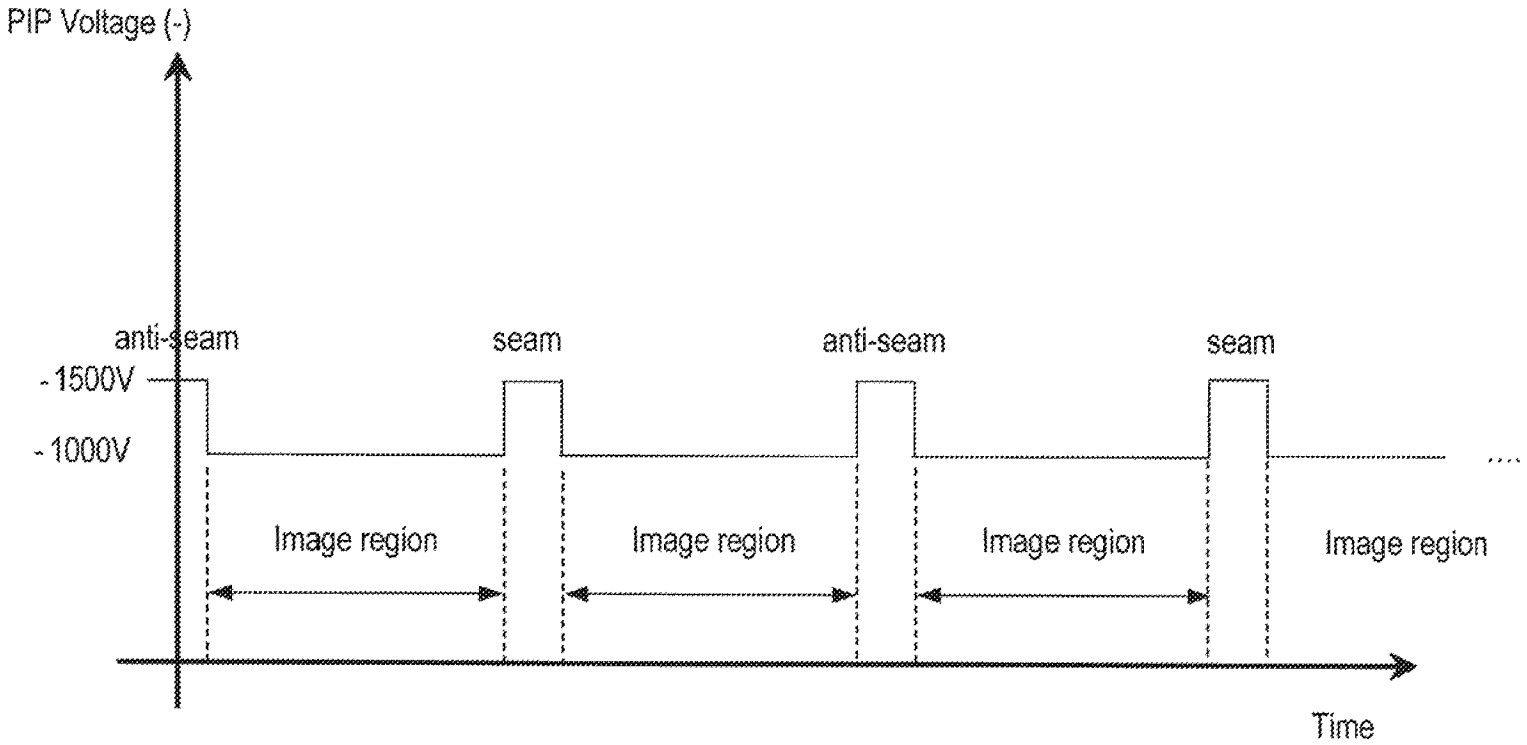
FIG. 6 shows a graph of voltage versus time of a charge roller as the charge roller is repeatedly passed across the seam of a rotating photo imaging plate.

In some examples, the voltage of the charge roller 104 is changed from a first voltage to a second voltage and back to the first voltage according to a DC step function, the voltage being reduced (i.e. such that it becomes more negative) across the seam 114. The voltage may be reduced, for example, by 500V, or more, which markedly reduces the accumulation of ink in the seam regions. Other voltages may also be used. A series of DC step functions are shown in FIG. 6, which shows an example of how the background voltage may be varied as the charge roller moves relative to the photo imaging plate, in which the DC steps are aligned so as to coincide with image and seam regions on the photo imaging plate 102.

In other examples an AC step may be used for changing the background voltage. For example, on an image area an AC+DC voltage may be applied (e.g. AC=1000×SIN(wt), where w=10 KHz). When passing through the seam the AC voltage can be increased, for example by 400V. An AC charge can help charging uniformity. When passing through the seam, charge roller to photo imaging plate gap variations can exist, and an AC voltage step can help smooth a charging level out. When using AC, a charging level of a photo imaging plate may not deviate from the average, regardless of what AC amplitude is used. In contrast to an AC step, a DC step changes the charging level of the photo imaging plate, helping to keep the seam of the photo imaging plate clean.

For industrial printers, which may print a number of large (for example B2 sized) sheets per second, the onset and offset of the DC step function should be rapid enough to accommodate the rapid rotation of the drum. Thus, according to some examples the charge roller should therefore be able to change the applied voltage within the order of several tens of milliseconds. Therefore, in some examples, the time delay across the DC step function as the voltage changes from the background voltage to the seam voltage is less than 50 μs. Such response times are not possible with non-industrial printers that may use other charging techniques for the background voltage, such as corona wire charging techniques, i.e. because corona wires have slow response times, and as such would not be suitable for the response times corresponding to the DC steps according to the examples described herein.

In some examples, the settling time at the charge roller DC output for a ±500V step is 20 μsec or less (the settling time is determined by the RC circuit of FIG. 2, a couple of milliseconds). It is noted that the response time may include the response time of the circuitry alone, and the response time of the charge roller itself and other elements in the circuit, such as wires, plugs, contacts with the photo imaging plate, and so on.

In the examples described herein it has been recognised that it is beneficial to use the charge roller 104 to change the background voltage across a seam 114, particularly for industrial printers. For example, although it could be possible to change the voltage of the electrostatic ink via the developer rollers 112, (i.e. as the way of providing a different potential difference in certain regions) the response time of the developer rollers has been found to be insufficient to enable the developer rollers to vary the DC voltage quickly enough to create a DC step in the voltage of the electrostatic ink over a seam 114 in an industrial printer. This is especially relevant to printers where the developer roller is associated with additional rollers such as squeegee and cleaner rollers (for example as disclosed in US2015/0071665). In addition, while controlling the background voltage using a charge roller according to some examples described herein may involve controlling a single voltage, in contrast, changing the voltage of a developer roller may involve controlling several different voltages, such as the coordinated control of other voltages of the cleaner and squeegee rollers mentioned above, in addition to controlling the voltage of the developer roller itself. These additional rollers tend to result in the developer roller circuitry having a larger response time (the response time is proportional to the resistance×the capacitance=RC) that is insufficient to accommodate the short transition time of industrial printers, and also having a more complex voltage control circuit compared to that of the examples described herein.

The examples described herein are also suited to industrial printers because of the comparatively high speed at which the photo imaging plates rotate, and hence at which the background voltage is varied at seam regions. For example, the linear speed of a photo imaging plate of an industrial printer may typically be greater than 50 cm per second, whereas a fast home printer will typically have a linear speed of less than 40 cm per second. The fast response times described in the examples above are therefore suited for use with fast moving industrial printers.

In some examples, parameters relating to how the background voltage is to be varied, such as the DC step size, the duration of the DC step and the time interval of the DC step will be pre-programmed for the printer. In other examples, such parameters may be updated in real time, for example, the printer may receive at least one parameter relating to how the background voltage is to be varied, e.g. the shape and/or duration of the DC step, at the same time as receiving data on the image to be printed.

According to another example, a method of printing electrostatic ink onto a print media comprises: applying a background voltage to a photo imaging plate using a charge roller that moves relative to the surface of the photo imaging plate; shining light onto selected areas of the photo imaging plate so as change the voltage of the selected areas of the photo imaging plate; and applying electrostatic ink to the photo imaging plate; wherein the voltage differences between the selected areas, the background voltage and the voltage of the electrostatic ink is such that the electrostatic ink is drawn to the selected areas of the photo imaging plate. The background voltage applied by the charge roller is varied as the charge roller moves relative to the surface of the photo imaging plate, such that the background voltage is varied in a region of the photo imaging plate where no ink is to be transferred.

According to another example there is provided an electro-photographic printer comprising: a photo imaging plate; and a charge roller to apply a background voltage to the photo imaging plate as the charge roller moves relative to the photo imaging plate. The charge roller varies the background voltage applied to the photo imaging plate as the charge roller moves relative to the photo imaging plate, such that the background voltage is varied in a region of the photo imaging plate where no ink is to be transferred.

In one example a printer varies the background voltage by reducing the background voltage across a seam of the photo imaging plate. In some examples a printer varies the background voltage by reducing the background voltage across an anti-seam of the photo imaging plate. Reduction in the background voltage may comprise reducing the voltage to a voltage that is more negative.

In some examples a printer varies the background voltage applied by the charge roller between a first voltage and a second voltage according to a DC step function. For example, the time delay across the DC step function as the voltage changes from the first voltage and the second voltage is less than 50 μs.

While the method, apparatus and related aspects have been described with reference to certain examples, various modifications, changes, omissions, and substitutions can be made without departing from the spirit of the present disclosure. It is intended, therefore, that the method, apparatus and related aspects be limited just by the scope of the following claims and their equivalents. It should be noted that the above-mentioned examples illustrate rather than limit what is described herein, and that many alternative implementations may be designed without departing from the scope of the appended claims.

The word "comprising" does not exclude the presence of elements other than those listed in a claim, "a" or "an" does not exclude a plurality, and a single processor or other unit may fulfil the functions of several units recited in the claims.

The invention claimed is:

1. A method of electro-photographic printing comprising:

applying a background voltage to a photo imaging plate using a charge roller that moves relative to the photo imaging plate; and varying the background voltage that is applied as the charge roller moves relative to the photo imaging plate, wherein the background voltage is varied in a region of the photo imaging plate where no ink is to be transferred, wherein the background voltage applied by the charge roller is varied between a first voltage and a second voltage according to a DC step function, wherein a time delay across the DC step function as the background voltage changes from the first voltage and the second voltage is less than 50 μs.

2. The method as in claim 1, wherein the background voltage is varied by changing the background voltage across a seam of the photo imaging plate.

3. The method as in claim 2, wherein a change in the background voltage comprises a reduction in voltage.

4. The method as in claim 3, wherein the reduction in voltage comprises reducing the background voltage to a voltage that is more negative.

5. The method as in claim 1, wherein the background voltage is varied by changing the background voltage across an anti-seam of the photo imaging plate.

6. A method of printing electrostatic ink onto a print media, the method comprising:

applying a background voltage to a photo imaging plate using a charge roller that moves relative to a surface of the photo imaging plate;

shining light onto selected areas of the photo imaging plate so as to change a voltage of the selected areas of the photo imaging plate; and applying an electrostatic ink to the photo imaging plate;

wherein voltage differences between the selected areas, the background voltage and a voltage of the electrostatic ink is such that the electrostatic ink is drawn to the selected areas of the photo imaging plate; and wherein the background voltage applied by the charge roller is varied as the charge roller moves relative to the surface of the photo imaging plate, such that the background voltage is varied in a region of the photo imaging plate where no ink is to be transferred, wherein the background voltage applied by the charge roller is varied between a first voltage and a second voltage according to a DC step function, wherein a time delay across the DC step function as the background voltage changes from the first voltage and the second voltage is less than 50 μs.

7. The method of claim 6, wherein the background voltage is varied by changing the background voltage across a seam or an anti-seam of the photo imaging plate.

8. An electro-photographic printer comprising:

a photo imaging plate; and a charge roller to apply a background voltage to the photo imaging plate as the charge roller moves relative to the photo imaging plate;

wherein the charge roller varies the background voltage applied to the photo imaging plate as the charge roller moves relative to the photo imaging plate, such that the background voltage is varied in a region of the photo imaging plate where no ink is to be transferred, wherein the background voltage applied by the charge roller is varied between a first voltage and a second voltage according to a DC step function, wherein a time delay across the DC step function as the background voltage changes from the first voltage and the second voltage is less than 50 μs.

9. The printer of claim 8, wherein the background voltage is varied by reducing the background voltage across a seam of the photo imaging plate.

10. The printer of claim 9, wherein a reduction in the background voltage comprises reducing the background voltage to a voltage that is more negative.

11. The printer of claim 8, wherein the background voltage is varied by reducing the background voltage across an anti-seam of the photo imaging plate.

* * * * *